United States Patent [19]

Sugiura et al.

[11] Patent Number: 4,646,330

[45] Date of Patent: Feb. 24, 1987

[54] PRESET COUNTER APPARATUS FOR COPYING MACHINES AND THE LIKE

[75] Inventors: Masamichi Sugiura; Tsuneo Kitagawa, both of Aichi, Japan

[73] Assignee: Minolta Camera Kabushiki Kaisha, Osaka, Japan

[21] Appl. No.: 327,020

[22] Filed: Dec. 3, 1981

[30] Foreign Application Priority Data

| | | | |
|---|---|---|---|
| Dec. 5, 1980 | [JP] | Japan | 55-172227 |
| Dec. 8, 1980 | [JP] | Japan | 55-173706 |
| Dec. 8, 1980 | [JP] | Japan | 55-173707 |
| Dec. 17, 1980 | [JP] | Japan | 55-179257 |

[51] Int. Cl.[4] ..... G07C 3/00; G03G 15/00

[52] U.S. Cl. ..... 377/15; 355/14 CU; 355/14 R; 377/2

[58] Field of Search ..... 377/15, 2; 355/14 CU, 355/14 R; 340/802, 825.19

[56] References Cited

U.S. PATENT DOCUMENTS

| | | | |
|---|---|---|---|
| 4,149,217 | 4/1979 | Tucker | 361/358 |
| 4,206,336 | 6/1980 | Cunningham | 219/10.49 R |
| 4,274,151 | 6/1981 | Kamiwaki | 368/21 |
| 4,309,598 | 1/1982 | Davis, Jr. | 377/17 |
| 4,315,685 | 2/1982 | Inuzuka et al. | 355/14 R |
| 4,394,087 | 7/1983 | Irie et al. | 355/14 E |

FOREIGN PATENT DOCUMENTS

| | | | |
|---|---|---|---|
| 54-145545 | 11/1979 | Japan | 355/14 R |
| 55-172227 | 12/1980 | Japan . | |
| 55-173706 | 12/1980 | Japan . | |
| 55-173707 | 12/1980 | Japan . | |
| 55-179257 | 12/1980 | Japan . | |

*Primary Examiner*—Joseph A. Orsino, Jr.

*Attorney, Agent, or Firm*—Price, Gess & Ubell

[57] ABSTRACT

A preset counter apparatus is provided for copying machines having a plurality of key inputs for increasing or decreasing the number of copies to be made. The timer is used to measure a predetermined increment of time for changing the numerical value upon the continuation of a key input. The rate of change of the number of copies to be reproduced can be progressively increased, at least across a predetermined number of increments of values, by the continued activation key member.

18 Claims, 14 Drawing Figures

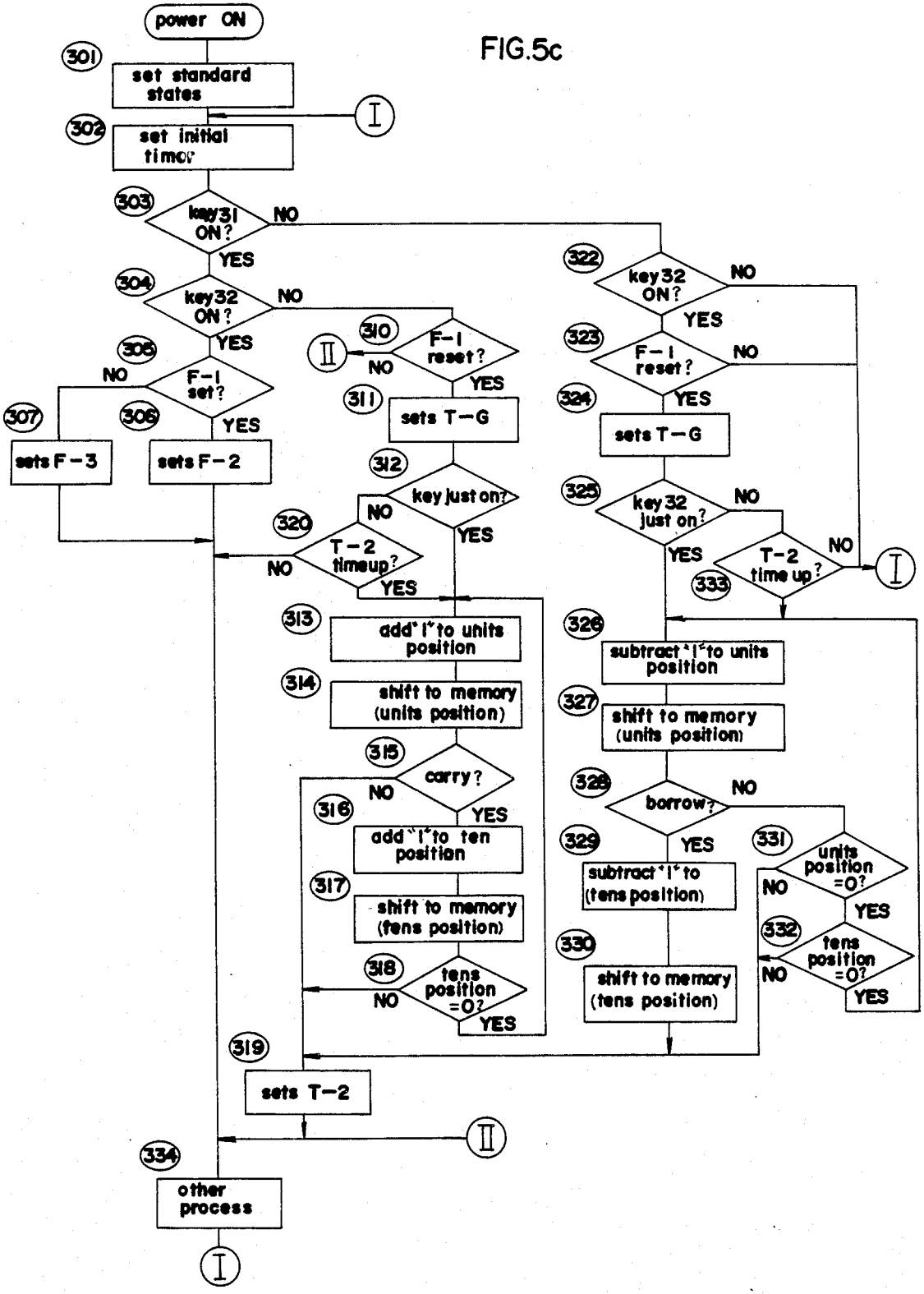
FIG.5c
power ON
301
set standard states
302
set initial timer
303
key31 ON?
NO
YES
304
key32 ON?
NO
YES
305
F-1 set?
NO
YES
306
sets F-2
307
sets F-3
310
F-1 reset?
NO
YES
311
sets T-G
312
key just on?
NO
YES
320
T-2 timeup?
NO
YES
313
add "1" to units position
314
shift to memory (units position)
315
carry?
NO
YES
316
add "1" to ten position
317
shift to memory (tens position)
318
tens position =0?
NO
YES
319
sets T-2
334
other process
322
key32 ON?
NO
YES
323
F-1 reset?
NO
YES
324
sets T-G
325
key32 just on?
NO
YES
333
T-2 time up?
NO
326
subtract "1" to units position
327
shift to memory (units position)
328
borrow?
NO
YES
329
subtract "1" to (tens position)
330
shift to memory (tens position)
331
units position =0?
NO
YES
332
tens position =0?
NO
YES
I
II

PRESET COUNTER APPARATUS FOR COPYING MACHINES AND THE LIKE

BACKGROUND OF THE INVENTION

1. Field of the Invention

The present invention relates to a preset counter apparatus for use, for example, in copying machines for setting and displaying the number of copies to be made continuously.

2. Description of the Prior Art

Preset counters heretofore generally used in copying machines for setting the number of copies to be made continuously are those of the mechanical rotary type comprising, for example, a setting dial and a ratchet wheel in combination. The dial is rotated by one division of its scale for every copying cycle and adapted to turn off a switch for continuing the copying operation when rotated to its final position. However, mechanical counter apparatus of this type require a mechanical coupling mechanism for driving the apparatus as associated with the copying operation, have the drawback of being complex in construction and expensive, are prone to malfunctions and are limited approximately to 20, if largest, in the number of copies to be set. Thus the use of the apparatus involves many problems.

On the other hand, with the progress of electronic technologies in recent years, IC, LSI and like elements are made available with an increased degree of integration and performance of enhanced stability at reduced costs. These elements are widely used for controlling mechanical apparatus, such as copying machines. Such elements have also found use in electronic counters, which are in combination with seven-segment number displays for indicating the count of the counter to provide preset counter apparatus.

When electronic counters are used, the number of copies is set by ten keys for setting the numbers "0" to "9". In the case where the circuit or program for the counter is designed according to a comparison system, the set value is stored in a memory, and a signal emitted every copying cycle is counted. When the count matches the stored value, the copying operation is discontinued. (U.S. Pat. No. 3,815,990, Newcomb et al., discloses this system although the counter disclosed is not of the electronic type.) Alternatively when a subtraction system is resorted to, a decrement is subtracted from the value set on the counter for every copying cycle, and the copying operation is discontinued when the count on the counter has reduced to "0" (U.S. Pat. No. 4,105,914, Murata et al.). In either case, the counter is associated with the copying operation only electrically, while the maximum number of copies to be made can be selected as desired, so that the electronic counter is free of many of the problems encountered with the foregoing mechanical counter apparatus. Accordingly counter apparatus incorporating such an electronic counter or program control system are widely used in copying machines, etc.

However, with LSI° s, microcomputers, etc. coming into wider use, copying machines and the like including electronic counters of this type are adapted for more versatile functions with a larger number of keys or displays for the instructions or selection by the user, while there arises a tendency to provide these keys and displays concentrically on a single operation panel to render the machine easy and efficient to operate. This leads to an increase in the area of the operation panel, a greater likelihood of handling or manipulation errors and an increased cost. These new problems are difficult to overcome especially in the case of compact copying machines in which only a limited space is available on the operation panel and which also involve limitations in respect of cost.

To solve the above problems, an apparatus has been proposed which has three input keys, namely UP key, DOWN key and CLEAR key, as disclosed in Published Unexamined Japanese Patent Application Sho No. 54-145545 (1979). Every time the UP key or DOWN key is depressed or when the key is held depressed, the numerical value shown on a seven-segment number display is increased or decreased, while the CLEAR key, when depressed, returns the displayed value to "1".

The proposed apparatus nevertheless is very cumbersome to use since when the number of copies to be set is large, the key must be depressed a large number of times or held depressed for a prolonged period of time.

SUMMARY OF THE INVENTION

The main object of the present invention is to provide a preset counter apparatus in which numerical values are settable on an electronic counter without employing the keys usually used for setting the numbers "0" to "9".

Another object of the invention is to provide a preset counter apparatus which is easy to use for setting numerical values efficiently, through a simple procedure and with use of approximately two input keys.

Another object of the present invention is to provide a preset counter apparatus which has an UP key for adding increments to numerical values and a DOWN key for subtracting decrements from numerical values and which is improved for setting numerical values rapidly and efficiently.

Another object of the present invention is to provide a preset counter apparatus wherein the numerical value to be displayed is changed by an increment of "1" upon lapse of every period of time set on a timer means which is started by an ON input from key input means, the timer value of the timer means being shortened stepwise when a continuous ON input is given by the key input means to thereby change the numerical value on display at an increased speed and to thereby set the desired numerical value rapidly.

Another object of the present invention is to provide a preset counter apparatus of the type described which has a RAPID UP key in addition to the UP key and the DOWN key so that numerical values can be set more rapidly.

Another object of the present invention is to provide a preset counter apparatus in which the maximum numerical value that can be displayed is changeable to the minimum numerical value that can be displayed and vice versa and which is thereby adapted to set numerical values rapidly.

Still another object of the invention is to provide a preset counter apparatus of the type described wherein when the UP key and the DOWN key are depressed at the same time while the apparatus is repeating its operation, the apparatus is controlled and prevented from operating repeatedly to thereby give the two keys a stopping function, the apparatus further additionally being so controllable that when the two keys are depressed at the same time while a condition is set to stop the operation of the apparatus, the numerical value on display is changed to the mimimun numerical value that can be displayed to thereby give the two keys a clearing function, whereby the apparatus is adapted to have a simplified operation panel.

More specifically, the present invention provides a preset counter apparatus for copying machines and the like comprising display means for displaying a set numerical value, key input means for increasing and/or decreasing the numerical value displayed, timer means to be started by an ON input of the key input means, and control means by which upon lapse of every period of time set on the timer means while a continuous ON input is being given by the key input means, the numerical value displayed on the display means is changed by "1" and the timer value of the timer means is decreased by a predetermined value to stepwisely shorten the period of time set on the timer means.

The present invention further provides a preset counter apparatus for copying machines and the like comprising display means for displaying a set numerical value, first key input means, second key input means, third key input means, and control means for adding an increment to the numerical value displayed when the first key input means is depressed, subtracting a decrement from the displayed numerical value when the second key input means is depressed and rapidly adding increments to the displayed numerical value when the third key input means is continuously depressed.

The present invention further provides a preset counter apparatus for copying machines and the like comprising display means for displaying a set numerical value, first key input means for addition, second key input means for subtraction, and control means for displaying on the display means the minimum numerical value that can be displayed when the first key input means is depressed while the maximum numerical value that can be displayed is displayed on the display means and for displaying on the display means the maximum numerical value that can be displayed when the second key input means is depressed while the minimum numerical value that can be displayed is displayed on the display means.

The present invention further provides a preset counter apparatus for copying machines and the like comprising display means for displaying a set numerical value, addition key input means for increasing the numerical value, subtraction key input means for decreasing the numerical value, and control means for causing the apparatus to operate repeatedly a specified number of times in accordance with a numerical value larger than "1" and displayed on the display means and for bringing the apparatus out of further repeated operation when the two key input means are depressed at the same time while the apparatus is repeating its operation. Additionally the control means of the apparatus having this feature is further so adapted that when the two key input means are depressed at the same time while a numerical value larger than "1" is displayed on the display means with a condition set for stopping the operation of the apparatus, the numerical value displayed on the display means is changed to the minimum numerical value that can be displayed.

The present invention will be described below in detail with reference to the accompanying drawings.

DETAILED DESCRIPTION OF THE INVENTION

The following description is provided to enable any person skilled in the copier art to make and use the invention and sets forth the best mode contemplated by the inventors for carrying out their invention. Various modifications however, will remain readily apparent to those skilled in the art, since the generic principles of the present invention have been defined herein specifically to provide an improved preset counter apparatus for copying machines.

Figure 1:
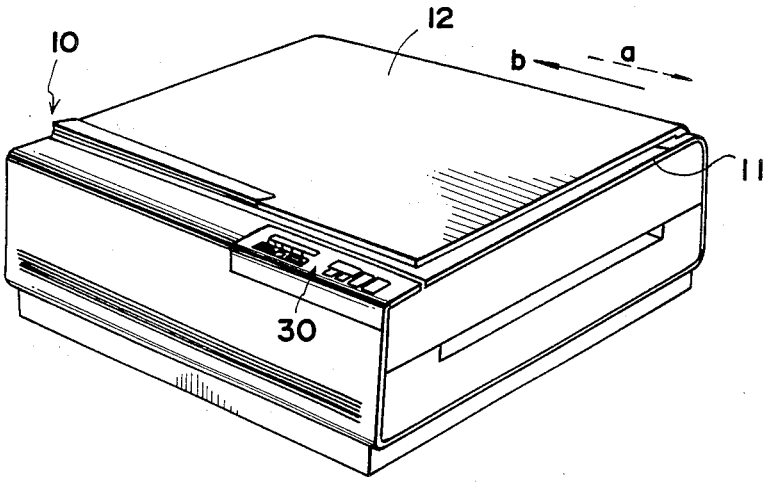
FIG. 1 is a perspective view showing the appearance of a copying machine equipped with a preset counter apparatus of the invention.
Figure 2A:
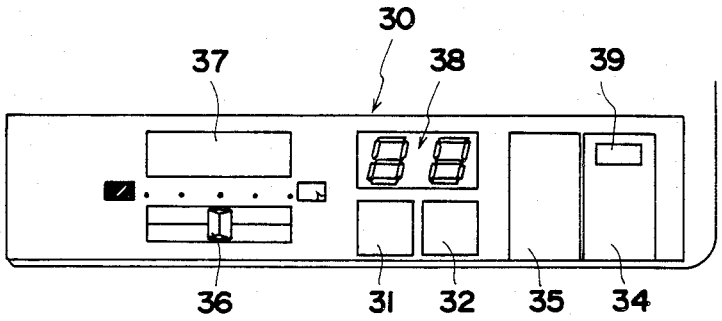
FIG. 2 (*a*), FIG. 2 (*b*) and FIG. 2 (*c*) are views showing operation panels for the copying machine.
Figure 2B:
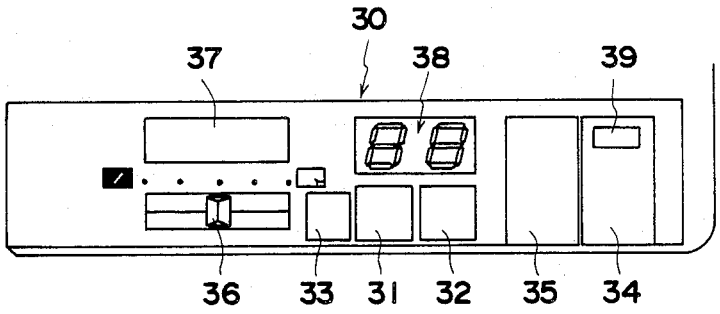
Figure 2C:
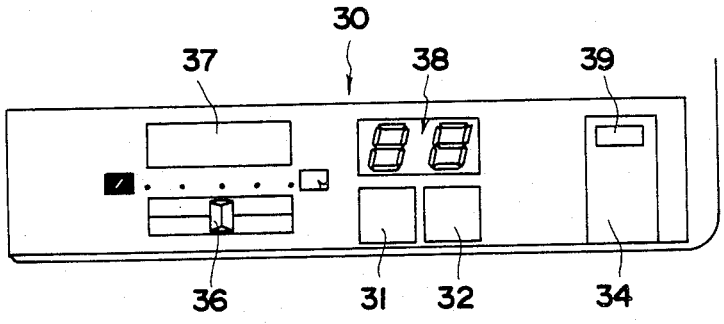

FIG. 1 is a perspective view showing the appearance of a copying machine 10 including a preset counter apparatus of the present invention. FIGS. 2 (*a*) to (*c*) are views showing operation panels 30 for use in different embodiments of the present invention. FIG. 2 (*a*) corresponds to a first embodiment, FIG. 2 (*b*) to a second embodiment, and FIG. 2 (*c*) to a third embodiment.

The copying machine 10 is provided on its top with an original support glass plate 11 which is reciprocatingly movable in the directions of arrows a and b. The glass plate 11 moves with an original cover 12 to cause an optical system, to be described later, to scan an unillustrated original and project the image thereof on to a photoconductive drum 13.

The operation panel 30 is provided at the upper end of an outer cover on the front side of the machine main body. In FIG. 2 (*a*), the operation panel 30 has an addition key 31, a subtraction key 32, a print key 34, a clear key 35, an image density adjusting knob 36, a display 37 for indicating paper jams or absence of paper or of toner, a number display 38 for showing numerical settings, a power supply indicator 39, etc. In addition to the above arrangement, the operation panel 30 shown in FIG. 2 (*b*) has a RAPID UP key 33, while the clear key 35 shown in FIG. 2 (*a*) is eliminated from the operation panel shown in FIG. 2 (*c*).

Figure 3:
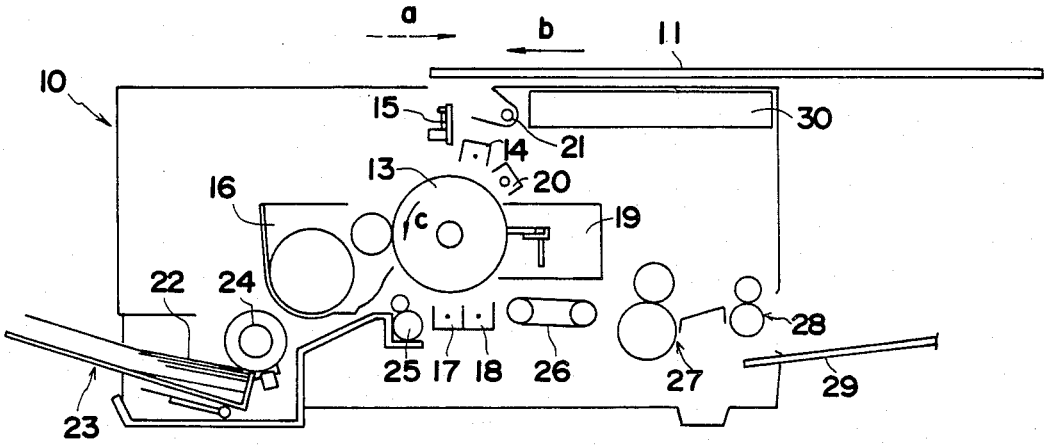
FIG. 3 is a view in section showing the copying machine.

FIG. 3 is a sectional view showing the construction of the copying machine 10. The construction and operation of the machine 10 will be described generally with reference to this drawing.

The photoconductive drum 13 is supported approximately in the center of the main body of the copying machine and is rotatable in the direction of arrow c. Arranged around the drum 13 are a sensitizing charger 14, an optical system 15 comprising an image transmitter formed by a bundle of optical fibers having graded refractive indexes, a developing unit 16, a transfer charger 17, an A.C. erasing charger 18, a cleaning unit 19, an eraser lamp 20, etc. If the glass plate 11 is not in its start position for scanning as seen in FIG. 1, the plate 11 moves in the direction of arrow a to the start position shown in FIG. 3 when an exposure lamp 21 preliminarily goes on with the initiation of a copying operation. When the exposure lamp 21 is thereafter fully turned on, the glass plate 11 moves in the direction of arrow b for the scan of the original, whereby the image of the original is continuously projected on the drum 13 during rotation to form a latent electrostatic image on the charged drum surface.

On the other hand, a sheet of copy paper 22 is sent out from a copy paper accommodating portion 23 having sheets of copy paper stacked therein, by a feed roller 24 rotatingly driven in timed relationship with the formation of the image on the drum 13 by the travel of the glass plate 11. The sheet 22 is fed to a transfer station as further accurately timed by a timing roller 25 with the movement of the image on the drum 13. The latent image on the drum 13 is converted by the developing unit 16 to a toner image, over which the sheet 22 is placed. The toner image is transferred onto the sheet 22 by the transfer charger 17. The sheet 22 is then passed over the A.C. erasing charger 18 and fed by a conveyor belt 26 to a fixing unit 27. The sheet 22 with the toner image fixed thereto is delivered onto a tray 29 by discharge rollers 28. After the transfer, the residual toner is removed from the drum 13 by the cleaning unit 19, while the residual charges are erased by the eraser lamp 20. The drum 13 is now ready for the next copying cycle.

Figure 4:
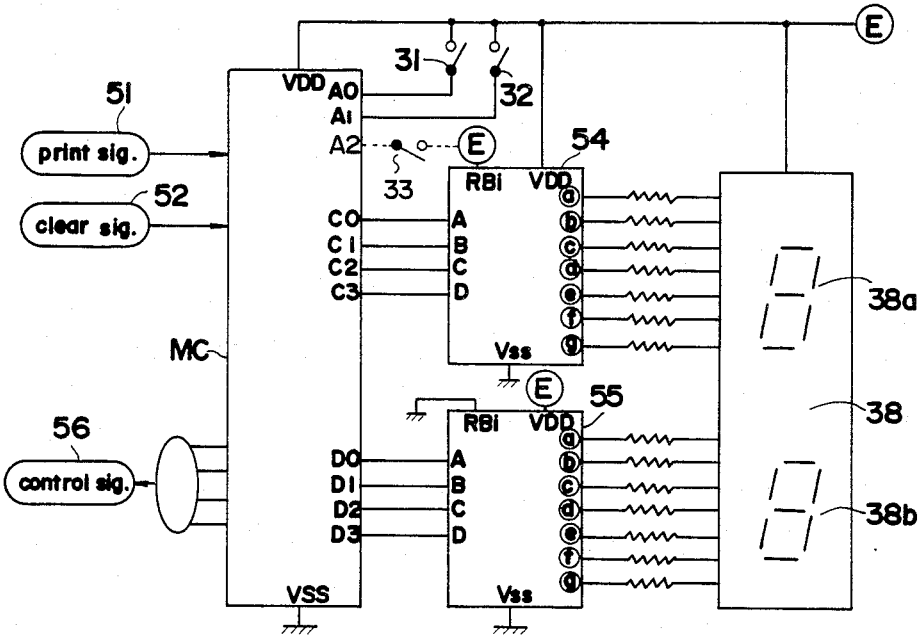
FIG. 4 is a circuit diagram showing the relation between a display and a microcomputer for controlling the copying machine and the preset counter according to the invention.

Prior to the above copying operation by the machine 10 having the foregoing construction, the number of copies to be made can be preset by manipulating the keys 31, 32 provided therefore on the operation panel 30 shown in FIG. 2. In accordance with the numerical value shown on the display 38, the copying cycle described is repeated continually. The operation of the copying machine including the presetting of the copy number and repetition of the copying cycle is controlled, for example, by a microcomputer MC as shown in FIG. 4. The control procedures, chiefly for presetting the copy number and repeating the copy cycle, will be described below with reference to FIGS. 5 (*a*) to 5 (*c*) and FIGS. 6 (*a*) to 6 (*d*).

The microcomputer MC has a generally known arrangement of unillustrated interior devices including a central processing unit (CPU), read-only memory (ROM), random access memory (RAM), accumulator (ACC), etc. The microcomputer MC receives input signals from the copy number setting input keys 31, 32, 33 and signals from the print key 34 and the clear key 35 and feeds control signals to BCD seven-segment decoders 54, 55 for controlling the numerical setting on the display 38 according to a predetermined program. The microcomputer MC also gives signals 56 for controlling the operation of the copying machine to execute a copying operation in accordance with the numerical setting. Both the decoders 54, 55, which control the number to be represented by an arrangement of light emitting elements of seven-segment display devices 38*a*, 38*b*, are adapted to display the digits "0" to "9" with combinations of high level "H" and low level "L" of the outputs from their output terminals (a) to (g). These outputs are controlled by the microcomputer MC. According to the contemplated use, seven-segment number display devices are used in a suitable combination. Other number display means are also usable. The binary data from output terminals C0 to C3 of the microcomputer MC is converted by the decoder 54, which delivers an output for controlling the number in the tens digit position to be shown on the display portion 38*a*. The binary data from output terminals D0 to D3 is converted by the decoder 55, which gives an output for controlling the number in the units digit position to be shown on the display portion 38*b*. Since the construction of the decoders 54, 55, etc. is already known, these devices will not be further described.

Figure 5A:
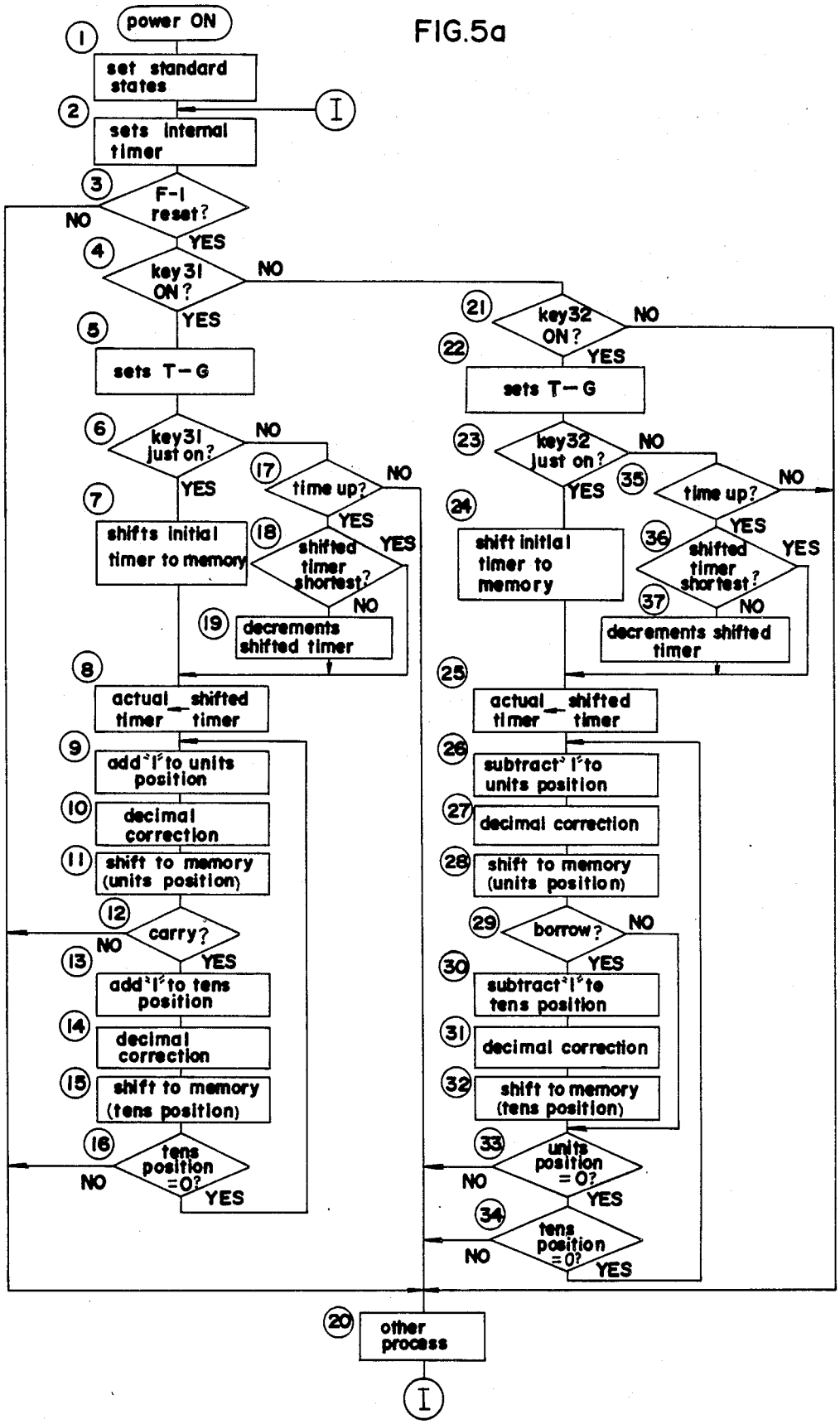
FIG. 5 (*a*), FIG. 5 (*b*) and FIG. 5 (*c*) are flow charts for illustrating embodiments of the invention, FIG. 6 (*a*), FIG. 6 (*b*), FIG. 6 (*c*) and FIG. 6 (*d*) are a series of flow charts for illustrating processing procedures for controlling copying operation.
Figure 5B:
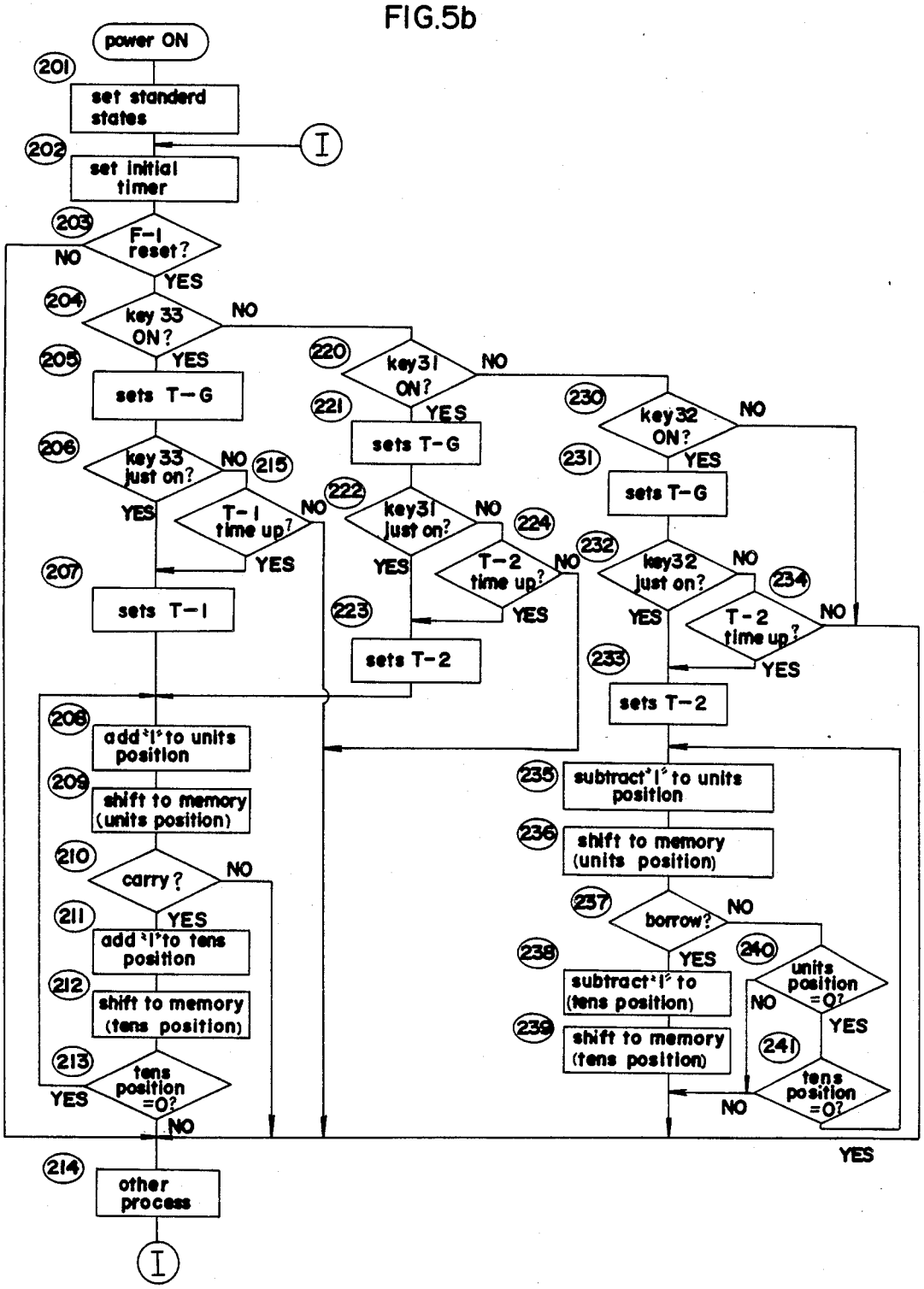
Figure 6A:
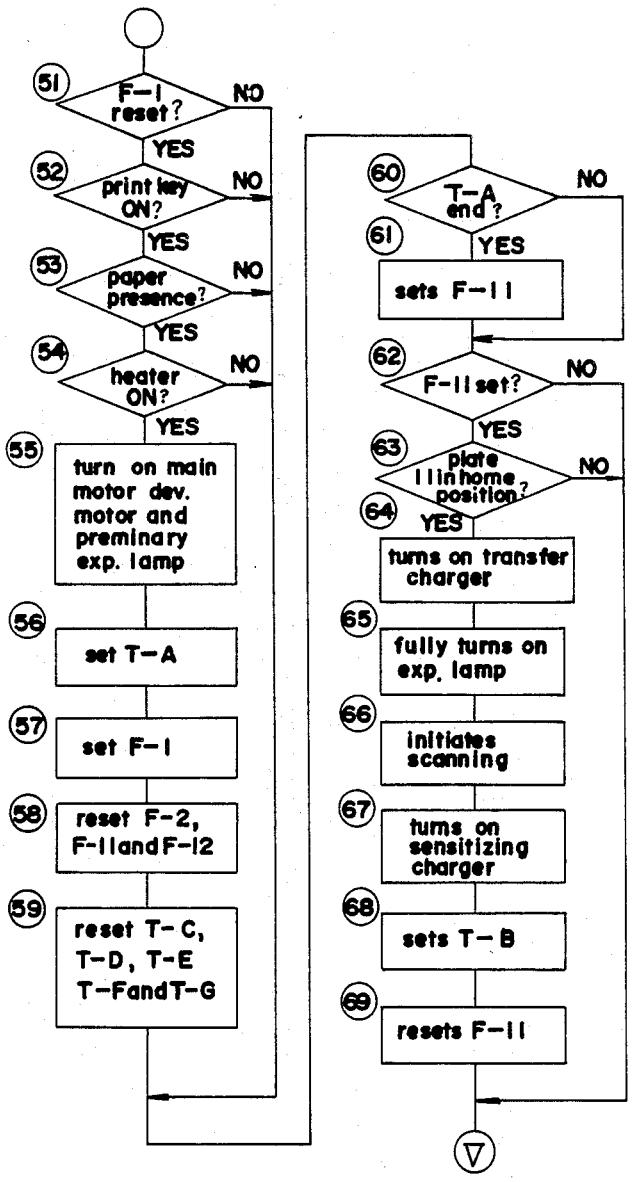
Figure 6B:
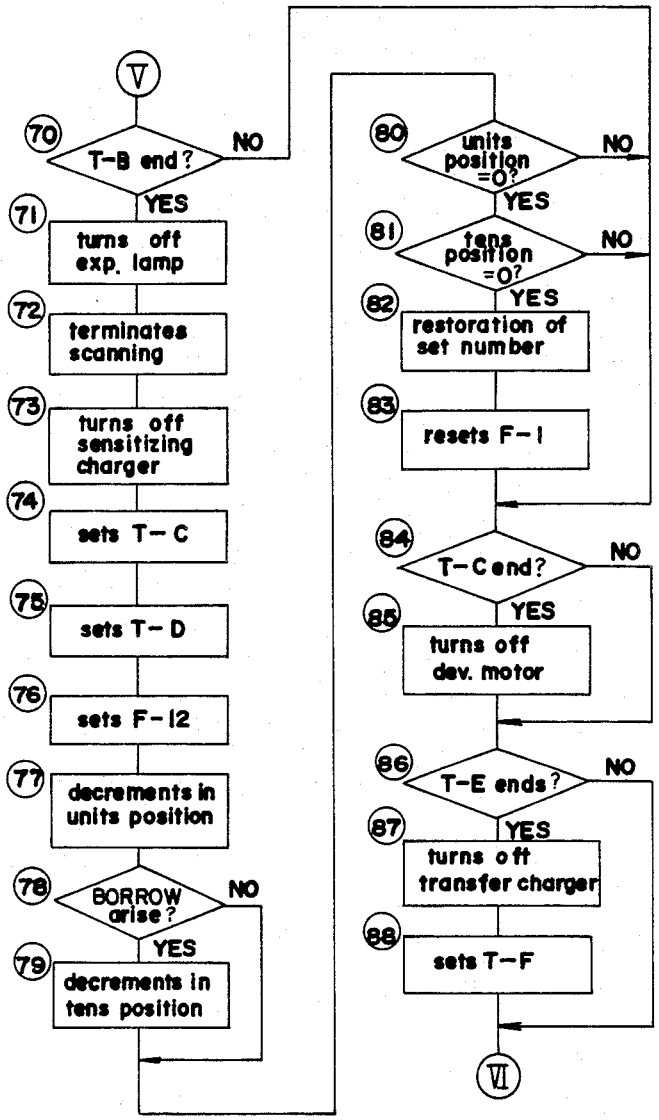
Figure 6C:
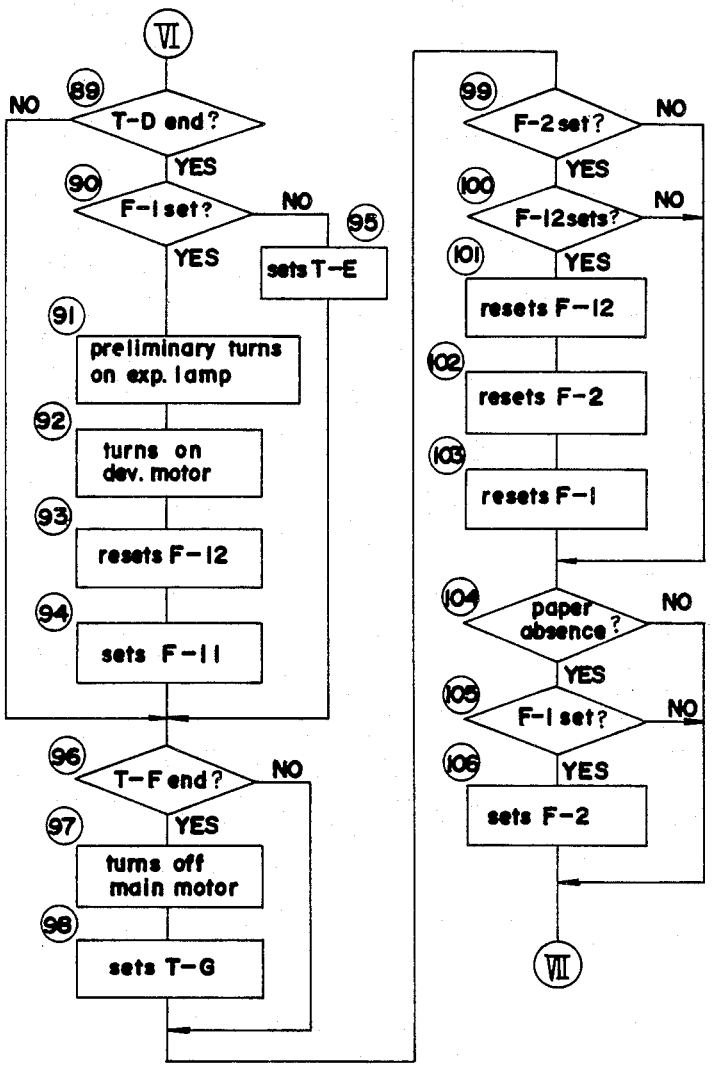
Figure 6D:
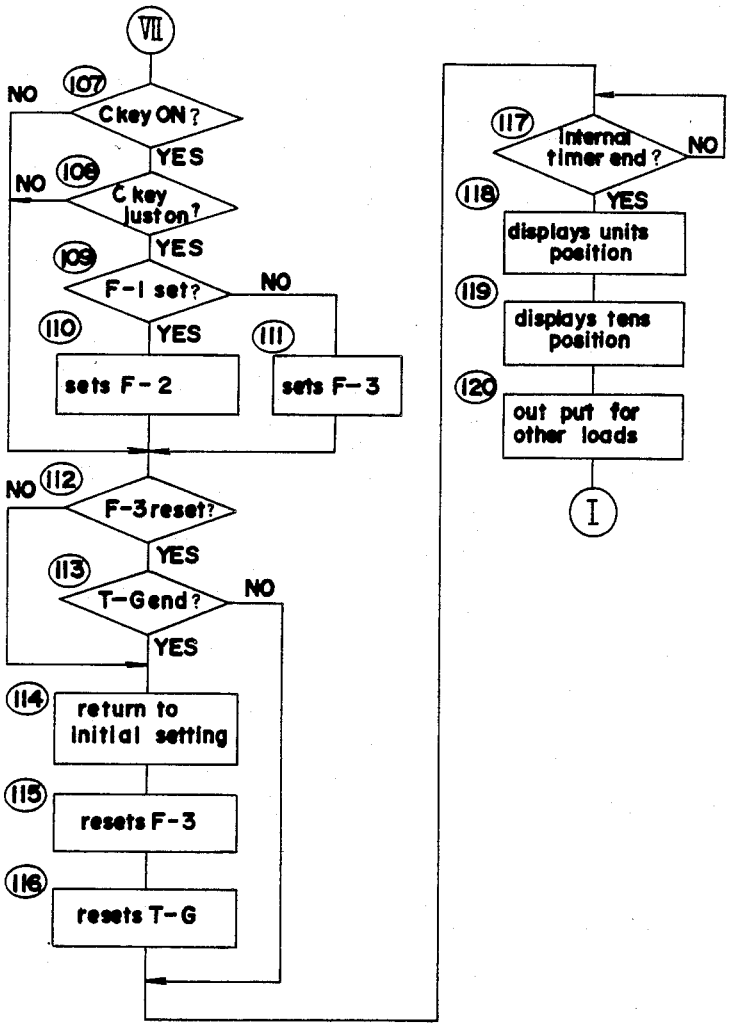

FIG. 5 (*a*) is a flow chart showing a first embodiment of this invention. The chart illustrates the procedures of process performed within the microcomputer MC for setting the number of copies with the keys 31, 32. For convenience of description, the following embodiments will be described with reference to a case in which a numerical value of two digits is set since the microcomputer operates similarly for settings of three or more digits.

When the power supply is turned on for the copying machine 10 as seen in FIG. 5 (*a*), the unillustrated heater of the fixing unit 27 is energized to start heating. With power also supplied to the power source E of the control circuit including the microcomputer MC, the microcomputer MC is also initiated into operation.

In step 1, the standard state of operation mode of the copying machine 10 is read from an internal store of the microcomputer MC, and the machine is set for operation. The term "standard state" refers to the standard operating conditions predetermined for the copying machine, for example, for making a single copy. Such conditions are shown on displays, or when desired, a movable member is returned to a specified position. When the copying machine is adapted to return to standard conditions in respect of copying magnification, paper size, heater temperature and image density which are selectively variable, the machine is set to the standard with respect to these conditions.

In step 2, an internal timer is set to the processing time for the microcomputer MC, i.e. the time for a routine of the program.

In step 3, a flag F-1 indicating continuation of the copying operation is checked. If it is reset, step 4 follows in which the UP key 31 is checked for depression. If the UP key 31 has been depressed, a timer T-G is set in step 5. The timer T-G functions to return the set conditions including the copy number to the standard state when no action is taken within a specified period of time after it has been set as specified. For example, it can be set for a period of about 30 seconds to about 1 minute, and is reset when the print key is depressed or if the copy number setting key is manipulated in the meantime. The timers to be set or reset in the process of the flow chart and including the timer T-G are digital timers that can be provided, for example, in a specified area of the RAM in the microcomputer MC and so programmed as to count a unit "1" for one routine. The time is set by presetting the numerical data to be so counted.

After the timer T-G has been set, step 6 checks the key 31 to determine whether or not it was depressed in the current routine. If the result is "YES", the initial value for a timer T is stored in a first area of the RAM in step 7. The ROM has the initial value written therein. Thus the value is read from the ROM and saved in the RAM. Subsequently, the data is read from the first area and stored in a second area of the RAM in step 8. The timer value thus stored in the second area functions as an actual timer for changing the numerical value on display. The value is stored in first and second areas in the form of a complement. "1" is counted up for the numerical value in the second area for every routine of the program. When this area is filled up, the time is up. The first and second areas are so designated for convenience and may be determined suitably in accordance with the value to be set on the timer.

In step 9, "1" is added to the stored value in the units position, followed by decimal conversion in step 10. The converted value is saved in the memory in step 11.

Step 12 checks whether or not the increment added in step 9 resulted in the necessity of transferring a carry. Accordingly, if the value saved in the memory is "0", "1" is added to the stored value in the tens position in step 13, followed by step 14 for decimal conversion. The result is stored in the memory in step 15.

The next step 16 checks whether or not the value in the tens position is "0". If it is "0", steps 9, 10, 11 and 12 are repeated. Step 20 is thereafter performed for "other process". When the step 16 reveals that a further increment has been added to the maximum value "99" that can be displayed, the value can be changed to the minimum value "1" to be displayed.

If the step 3, 12 or 16 prove "NO", step 20 directly follows.

When the result of step 6 is "NO", indicating that the key is depressed before the current routine is still on, step 17 checks whether or not the time set on the actual timer in the previous routine has elapsed. If the result is "NO", step 20 directly follows.

If the result of step 17 is "YES", step 18 checks which timer value is the shortest by comparing the timer value stored in the first area of the RAM with the shortest value written to the ROM. When the value of the timer is not the shortest, the timer value in the first area of the RAM is reduced by subtraction in step 19. Since the timer value is stored in the form of a complement, this subtraction is performed by addition to the complement. The timer value resulting from the subtraction is stored in the second area in step 8. Steps 9 to 16 are thereafter performed as already described.

The timer T is set, for example, to an initial value of 500 msec, a shortest value of 200 msec and a subtracted value of 50 msec. When the key 31 is held depressed, steps 4, 5, 6, 7, 8, 9, 10, 11, 12 and 20 give a numerical value of "2", and 500 msec thereafter, the value changes to "3" through steps 4, 5, 6, 17, 18, 19, 8, 9, 10, 11, 12 and 20. Subsequently increments are added to the value at stepwisely decreasing intervals of 450, 400, 350, 300, 250 and 200 msec. After the value has increased to "9", the timer value remains the shortest, so that step 18 is followed by step 8 for counting up at the shortest interval.

When the DOWN key 32 is depressed instead of the UP key 31, step 21 is performed after step 4. The timer T-G is set in step 22. Step 23 checks the key 32 for depression. When step 23 proves "YES", the initial value for the timer T is saved in step 24, and the saved value is adapted to serve as an actual timer in step 25. These steps are carried out in exactly the same manner as the foregoing steps 7 and 8, using the first and second of the RAM in common.

In the next step 26, "1" is subtracted from the stored value in the units position, followed by step 27 for decimal conversion and further by step 28 in which the converted value is saved in the memory.

Step 29 checks whether or not a borrow arises in the subtraction If the subtraction of step 26 entails a change from "0" to "9" (decimal number), the result is "YES". In this case, "1" is subtracted from the stored value in the tens position in step 30. After decimal conversion, the result is saved in the memory in step 32. When the result of step 29 is "NO", steps 33 and 34 check whether or not the stored values in the units position and the tens position are "0". When the units value is not "0" and also when the tens value is not "0" with "0" in the units position, step 20 is performed. When "0" is in both the units and tens positions, the units value is changed to "9" in step 26, and the tens value also to "9" in step 30. Thus when subtraction by the key 32 is continued, the minimum value "1" that can be displayed changes to the maximum value "99" that can be displayed.

If the result of step 23 is "NO", i.e. when the key 32 has been continuously on since the previous routine, steps 35, 36 and 37, which are exactly the same as steps 17, 18 and 19, are performed. In this way, the numerical value decreases stepwise at an increased speed when the DOWN key 32 is held depressed.

More specifically, the foregoing procedures are executed in the following manner for setting the number of copies.

When the power supply is turned on, the value "0" is set in the tens position and the value "1" in the units position by the initialization of step 1. The display 38 shows the value "1" in the units position only on the display portion **38*b*, but the display portion 38*a* remains blank for the following reason. With reference to FIG. 4, RBI terminal of the decoder 54 for controlling the number in the tens position is set to "H", while RBI terminal of the decoder 55 for controlling the number in the units position is set to "L". The decoders 54, 55** are further so adapted that when the input terminals A to D of each decoder are all "L" (corresponding to the value "0"), the outputs (a) to (g) are all "L" (blank) if the RBI terminal is "H", or "0" is displayed (for example, (g) only is "L" and the others "H") if the RBI terminal is "L". Accordingly the value "0" is not shown in the tens position.

The number of copies is then set by manipulating the UP key 31 and/or DOWN key 32.

These keys can be manipulated in two ways. Every time the UP key 31 or DOWN key 32 is depressed momentarily, "1" is added to or subtracted from the set value. Alternatively, when the key is held depressed, "1" is continuously added or subtracted upon lapse of every time period set on the timer T. The timer value of the timer T itself decreases every preset period to expediate the stepwise variation of the value.

Thus the desired copy number is set by depressing the UP key 31 a number of times or by depressing the key continuously. If the set number exceeds the desired copy number, the DOWN key 32 is used for subtraction.

Further according to the present embodiment, it is possible to change the maximum value "99" that can be displayed through the UP key 31 to the minimum value "1" that can be displayed, and also to change the minimum value "1" that can be displayed through the DOWN key 32 to the maximum value "99" that can be displayed. Accordingly the initial setting "1" can be changed, for example, to "70" by the DOWN key 32 more rapidly than by the UP key 31. Furthermore a copy number of "70" can be changed to "30" with the use of the UP key 31 only. Since the present embodiment has the clear key 35, it is of course possible to return the setting to the initial setting and thereafter set the desired value by manipulating the UP key 31 or DOWN key 32.

After the copy number has been set in this way, step 20 is preformed for "other process".

The first embodiment described has the feature that the value can be changed stepwise at an increased speed by continuously depressing the value setting key, whereby the desired copy number can be set rapidly.

FIG. 5 (*b*) is a flow chart showing a second embodiment of the invention.

Steps 201 to 203 are performed to execute the same process as in steps 1 to 3 of the first embodiment.

The RAPID UP key 33 is checked in step 204. If the result is "NO", step 220 for checking the UP key 31 usually follows. If "YES", the timer T-G is set in step 205.

Step 206 checks whether or not the key 33 is depressed in the current routine. If the key 33 is turned on in the current routine, a timer T-1 is set in step 207. In step 208, "1" is added to the stored value in the units position, followed by decimal conversion. In step 209, the result is saved in the memory for temporary storage. The next step 210 checks whether or not the result is "0". If it is not "0", step 214 is performed for "other process", but if it is "0", step 211 is performed to add the carry "1" to the stored value in the tens position and effect decimal conversion. The result is saved in the memory in step 212. Subsequently step 213 checks whether or not the stored value in the tens position is "0". When it is not "0", step 214 follows, but if it is "0", step 208 is repeated, followed by steps 209 and 210 and further by step 214. Thus the value stored in the memory changes from the maximum value "99" that can be displayed to the minimum value "1" that can be displayed.

When step 206 proves "NO", whether or not the time set on the timer T-1 in step 215 in the routine preceding the checking has elapsed is checked. If the result is "YES", step 207 is performed. When the key 33 is held depressed, the timer T-1 is used for adding the increment "1" to the value upon the lapse of time set thereon. The timer is set, for example, to about 200 msec. With the key 33 held depressed, steps 204, 205, 206, 215, 207, 208, 209, 210, 211, 212 and 213 are repeated to continuously add "1" to the value upon the lapse of every set period. In this case, the timer T-G is set again every routine. If the result of step 215 is "NO", step 214 directly follows.

If step 204 indicates that the key 33 is not on, step 220 usually checks whether or not the UP key 31 is depressed. Steps 221, 222, 223 and 224 thereafter follow to perform the same process as in steps 205, 206, 207 and 215 for the RAPID UP key 33. However, a timer T-2 is set in step 223 to a longer period of time than the timer T-1, e.g. to 500 msec. Accordingly an increment is continuously added through the repetition of steps 204, 220, 221, 222, 224, 223, 208, 209, 210, 211, 212 and 213 with the key 31 on, in the same manner as above but at a longer interval than is the case with the RAPID UP key.

When step 220 indicates that the key 31 is not on, DOWN key 32 is checked for depression in step 230. If the check result is "YES", steps 231, 232, 233 and 234 are performed for the same process as in steps 221, 222, 223 and 224. In the next step 235, "1" is subtractd from the stored value in the units position and the result is subjected to decimal conversion. In step 236, the result is temporarily stored in the memory. Next, step 237 detects a borrow, if any. If the result is "YES", "1" is subtracted from the stored value in the tens position, followed by decimal conversion in step 238. The result of subtraction is saved in the memory in step 239. On the other hand, if no borrow is detected, steps 240 and 241 check whether or not the units and tens values stored are "0". When the units value is not "0" and also when the units value is "0" but the tens value is not "0", step 214 is performed. If both the units and tens values are "0", step 235 is repeated to change the value in the units position to "9". The value in the tens position is changed also to "9" in step 238. Thus when subtraction is continued by the key 32, the minimum value "1" that can be displayed is subsequently changed to the maximum value "99" that can be displayed.

When the result of step 230 is "NO" and also when that of step 234 is "NO", step 214 directly follows.

More specifically the number of copies is set in the following manner according to the above procedures.

When the power supply is turned on, the value "0" is set in the tens position and the value "1" in the units position by the initialization of step 201. The display 38 shows the value "1" in the units position only on the display portion 38*b*, but the display portion 38*a* remains blank without showing "0".

The copy number is then set by manipulating one of the keys 31, 32 and 33. With the preset counter apparatus of the second embodiment, the copy number can be set by selectively using the three keys in several ways to set the desired number most rapidly, as will be described below in four cases.

(1) FOR A SMALL NUMBER OF COPIES

The desired copy number is set through the repetition of steps 204, 220, 221, 222, 224, 223, 208, 209, 210, 211, 212 and 213 of FIG. 5 (*b*) by continuously depressing the UP key 31 or turning on and off the key a required number of times. When the set number exceeds the desired number, the DOWN key 32 is depressed to perform steps 230, 231, 232, 234, 233, 235, 236, 237, (240), 238 and 239 for subtraction.

(2) FOR A LARGE NUMBER OF COPIES

The RAPID UP key 33, and the UP key 31 or DOWN key 32 are used in this case. A number approximate to the desired number is set by the RAPID UP key 33, and the desired number is thereafter set by the UP key 31 or DOWN key 32. In this case, the RAPID UP key 33 functions by being held depressed to execute steps 204, 205, 206, 207, 208, 209, 210, 211, 212, 213 and 214 of FIG. 5 (*b*) for the first routine and to repeat steps 204, 205, 206, 207, 208, 209, 210, 211, 212, 213 and 214 for the following routines. After a number approximate to the desired number of copies has been set, the UP key 31 or DOWN key 32 is used to set the desired number through the steps mentioned in the preceding case (1).

Although large copy numbers are settable of course by the UP key 31 only, the key must then be depressed a large number of times or held depressed for a prolonged period of time, and is hence cumbersome. However, large numbers can be set rapidly by the RAPID UP key 33 since the timer T-1 therefor is set for a shorter period of time than the timer T-2 for the UP key 31 and DOWN key 32.

(3) FOR A LARGE COPY NUMBER APPROXIMATE TO THE MAXIMUM NUMBER

As already described, the preset counter apparatus of the invention is so adapted that "1" (minimum value that can be displayed) changes to "99" (maximum value that can be displayed) when the DOWN key 32 is depressed, permitting subsequent subtraction from "99". Accordingly, "98", for example, can be set very rapidly merely by depressing the DOWN key 32 only. In this case, steps 204, 220, 230, 231, 232, (234), 233, 235, 236, 237 (240, 241), 238, and 239 are executed as shown in FIG. 5 (*b*). More specifically stated, if no borrow is detected in step 237 and the units and tens values are found to be "0" in steps 240 and 241, step 235 is repeated to subtract "1" from the units position, and "1" is further subtracted from the tens position in step 238 to change "1" to "99".

(4) FOR CHANGING A SETTING CLOSE TO THE MAXIMUM TO A VALUE CLOSE TO THE MINIMUM

The preset counter apparatus of the invention is so adapted that when "0" is present in step 213, step 208 is repeated for addition. Accordingly "99" (maximum number of copies) can be changed to "1" (minimum number of copy). It is therefore possible to change a setting, for example, of "98" to "2" by the UP key 31 only. With the second embodiment, it is of course possible to return the existing setting to "1" by the clear key 35 and thereafter follow the procedure of the case (1), but "98" can be changed to "2" by the UP key 31 only without manipulating both the clear key 35 and UP key 31.

The desired value can be set also with the use of the RAPID UP key 33, as when a setting, for example, of "70" is to be changed to "30". The setting "70" is changed to a value approximate to "30" by continuously depressing the RAPID UP key 33. The desired value "30" is then set by the UP key 31 or DOWN key 32.

The second embodiment described has the feature that the RAPID UP key is provided in addition to the UP key and DOWN key, whereby numerical values are settable rapidly.

FIG. 5 (*c*) is a flow chart showing a third embodiment of the invention. Steps 301 and 302 are the same as steps 1 and 2 of the first embodiment.

The next step 303 checks whether or not the UP key 31 is on. If the result is "YES", step 304 further checks whether or not the DOWN key 32 is on. If the result of step 304 is also "YES", i.e. if both UP key 31 and DOWN key 32 are on at the same time, a flag F-1 indicating continuation of copying operation is checked in step 305. When it is set, step 306 sets a flag F-2 for indicating an instruction to discontinue the copying operation. If the flag F-1 is reset, step 307 sets a flag F-3 for clearing the copy number setting. Step 334 thereafter follows for "other process".

Figure 7:
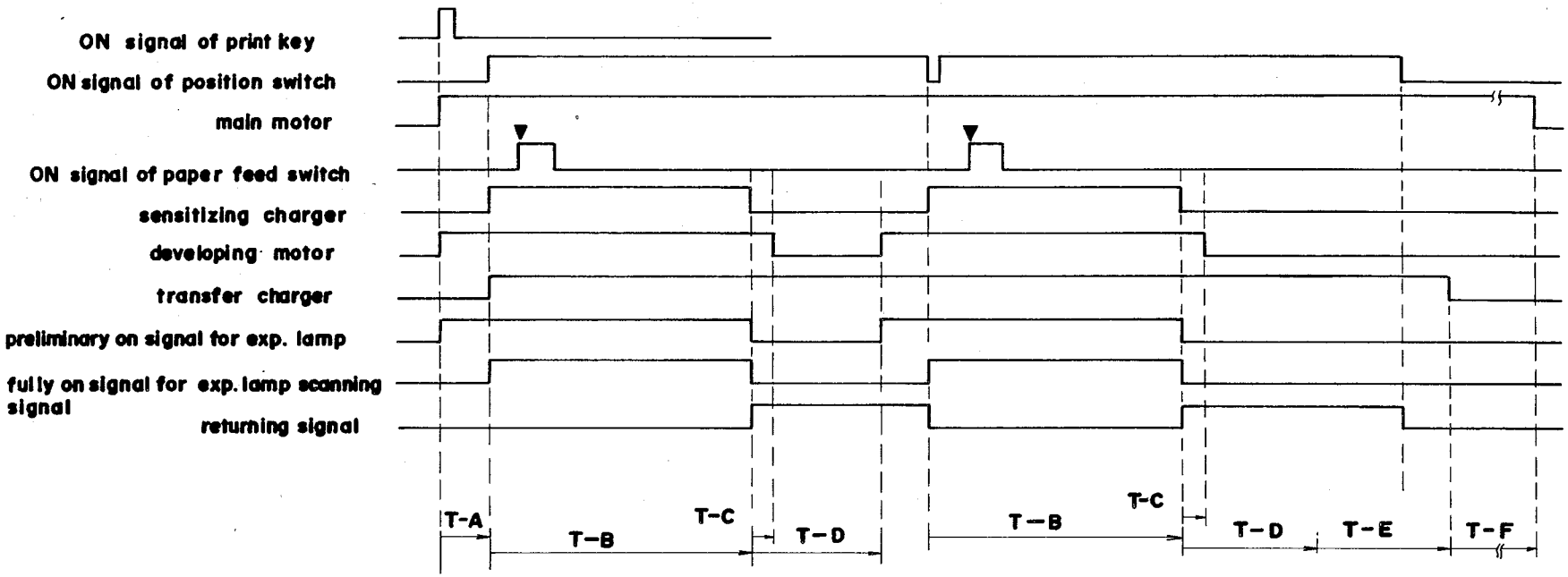
FIG. 7 is a time chart for controlling the copying operation.

While these flags F-2 and F-3 are checked in the routine to be described in detail with reference to FIG. 6 illustrating the "other process" of step 334, the flag F-1 indicating continuation of copying operation is reset when the flag F-2 is set, provided that flag F-12 for accepting a copying operation stopping signal has been set, whereby the subsequent copying operation is discontinued even if the machine is in operation for making many copies. The flag F-12 is set on completion of a scan of the scanning system and is reset upon the lapse of time set on a time T-D (see FIG. 7) which is set simultaneously with the completion of the scan. Thus, while the stopping signal is acceptable at any time, the process by the microcomputer MC for stopping the following copying cycle in response to the signal is carried out after the completion of a scan by the scanning system.

When the flag F-3 is set, the set number of copies is changed to the initial setting "1". Since the flag F-3 is set on condition that the flag F-1 is reset, the flag F-3 is set after the flag F-1 has been reset by the flag F-2, i.e. after the completion of scanning or before the machine is brought into copying operation with the flag F-1 reset although the copy number has been set.

When step 304 proves "NO", the flag F-1 is checked in step 310. If the flag F-1 is found to be set, step 334 is performed, but if it is reset, the timer T-G is set in step 311.

Step 312 checks whether or not the key 31 is depressed in the current routine. If the result is "YES", step 313 is performed in which "1" is added to the stored value in the units position, followed by decimal conversion. The result is saved in the memory in step 314. The next step 315 checks whether or not the result of addition is "0". If it is "0", the carry "1" is added to the stored value in the tens position and the result is subjected to decimal conversion in step 316. The result of addition is saved in the memory in step 317. Next, step 318 checks whether or not the stored value in the tens position is "0". If is "0", step 313 is repeated, followed by step 314 and further by step 319. Thus the value stored in the memory is changed from the maximum value "99" that can be displayed to the minimum "1" that can be displayed.

When the results of steps 315 and 318 are both "NO", step 319 is performed in which a timer T-2 is set. When the key is held depressed, "1" is added to or subtracted from the value upon lapse of time set on the timer T-2 as is the case with the timer T-2 in the second embodiment. When the result of step 312 is "NO", i.e. when the key 31 is continuously on, the timer T-2 is checked in step 320. Before the time set thereon is up, step 320 is followed by step 334, but if the time is up, "1" is added through the routine of steps 313, 314, 315, 316, 317 and 318. Accordingly when the key 31 is held depressed, the increment is added upon lapse of every period of time set on the timer T-2 through the above routine. In this case, the timer T-G is set again every routine.

When the result of step 303 is "NO", the key 32 is checked is step 322. If the key 32 is on, steps 323, 324, the same as steps 310, 311, are performed. Step 325 checks whether or not the key is depressed in the current routine. If the result is "YES", "1" is subtracted from the stored value in the units position, and the result is subjected to decimal conversion in step 326. The result of subtraction is saved in the memory in step 327. The next step 328 detects a borrow, if any. When the borrow is detected, "1" is subtracted from the stored value in the tens position and the result is subjected to decimal conversion in step 329. The result of subtraction is saved in the memory in step 330. On the other hand, if no borrow is detected, whether or not the stored values in the units and tens positions are "0" is checked in steps 331, 332. When the units value is not "0" and also when the units value is "0" but the tens value is not "0", step 319 is performed. If the units and tens values are both "0", step 326 is repeated to change the units value to "9", and the tens value is also changed to "9" in step 329. Thus when subtraction is continued by the key 32, the minimum value "1" that can be displayed is subsequently changed to the maximum "99" that can be displayed.

When the result of step 325 is "NO", whether or not the time set on the timer T-2 in step 319 of the routine preceding the checking has elapsed is checked. If the result is "YES", step 326 is performed. As already described, addition or subtraction is conducted every time the period time set on the timer T-2 elapses. When the key 32 is held depressed, a decrement is continuously subtracted every time the set time is up.

If the result of step 322, 323 or 333 is "NO", step 334 directly follows.

More specifically the number of copies is set in the following manner according to the above precedures.

When the power supply is turned on, the value "0" is set in the tens position and the value "1" in the units position by the initialization of step 301. The display 38 shows the value "1" in the units position only on the display portion 38*b*, but the display portion 38*a* remains blank.

The copy number is then set by manipulating the UP key 31 or DOWN key 32.

Every time the UP key 31 or DOWN key 32 or the preset counter apparatus according to the third embodiment is depressed, "1" is added to or subtracted from the set value. Alternatively when either one of the keys is held depressed, "1" is continuously added or subtracted upon lapse of every time period set on the timer T-2.

Thus the desired copy number can be set by depressing the UP key 31 a number of times or by depressing the key continuously. If the number set by addition exceeds the desired copy number, the DOWN key 32 is used for subtraction to set the desired number. The addition is carried out through steps of 303, 304, 310, 311, 312, (320), 313, 314, 315, 316, 317, 318 and 319, while the subtraction is carried out through steps 303, 322, 323, 324, 325, (333) 326, 327, 328, 329, 330 and 319.

The preset counter apparatus according to the third embodiment is characterized in that while the machine is in operation for making copies, the operation can be discontinued by depressing the UP key 31 and the DOWN key 32 at the same time and that the number of copies can be returned to the initial setting "1" by depressing the two keys at the same time after the discontinuation. This can be realized when the results of steps 303 and 304 are both "YES", by setting the flag F-2 to discontinue the copying operation if the flag F-1 is in set state (i.e. if the machine is in operation), and by setting flag F-3 to restore the initial setting "1" if the flag F-1 is in reset state (i.e. if the machine is set for condition to stop the copying operation). Thus the keys perform the same function as the clear key used on conventional apparatus. Accordingly when an incorrect copy number is set or when it is desired to change the number of copies in the course of copying operation, the keys 31 and 32 can be depressed at the same time for the correction or change. This feature can be incorporated into the foregoing first and second embodiments.

The common feature of the first, second and third embodiments described above is that when addition is performed after the maximum numerical value that can be displayed has been reached, the maximum changes to the minimum numerical value that can be displayed for further addition and that when subtraction is performed after the minimum numerical value that can be displayed has been reached, the minimum changes to the maximum value that can be displayed for further subtraction.

The system wherein the conventional UP key and DOWN key are used is not adapted for further addition or subtraction after the maximum value or minimum value has been reached, whereas according to the present invention, the initial setting "1" can be changed, for example, to "90" only by the subtraction key 32. Further when it is desired to change the setting from "90" to "5", this can be accomplished only by the addition key 31. Thus the desired number of copies can be set much more rapidly than when the setting is changed to "90" by the addition key or when the setting is changed from "90" to "5" by the subtraction key.

The same advantage will result from the use of the RAPID UP key 33 of the second embodiment for addition. When the preset counter apparatus of this invention has the fourth feature in combination with the features of the first, second and third embodiments, copy numbers can be set at a further increased speed.

FIGS. 6 (*a*) to (*d*) are flow charts showing an example of "other process" of steps 20, 214 and 334 in FIGS. 5 (*a*) to (*c*). For illustrative purposes, display of numerical values set according to the flow charts of FIGS. 5 (*a*) to (*c*), automatic clearing mechanism following the lapse of time set on the timer T-G, sequential control of the copying machine following the depression of the print key, etc. are shown. The processing procedures of FIGS. 6 (*a*) to (*d*) will be described below with reference to the time chart of FIG. 7. In the third embodiment from which the clear key 35 is omitted, the keys 31 and 32 serve the function of the clear key as already described with reference to the flow chart of FIG. 5 (*c*). It is therefore to be noted that the steps 107 to 111 to be described with reference to FIG. 6 (*d*) are eliminated in the case of the third embodiment.

In step 51 of FIG. 6 (*a*), the flag F-1 is checked for resetting. When the result is "YES", step 52 checks the print key 34 for depression. If the key is on, the presence or absence of copy paper 22 and the temperature of the fixing unit 27 are checked in steps 53 and 54 respectively. When the copy paper 22 is not set in position or when the temperature is lower than is specified, the input of the print key is not accepted. Examples of means for detecting the paper and the temperatures are already well known and are therefore not illustrated or described.

When the print key 34 is turned on with the copy paper, fixing unit, etc. in condition for operation, steps 55 to 59 are performed to energize the main motor (not shown) and developing motor (not shown), to preliminarily turn on the exposure lamp 21, to set a timer T-A for starting a scanning movement, to set the flag F-1 indicating the continuation of copying operation, to reset a flag F-2 indicating instructions for stopping copying operation and flags F-11, F-12, and to reset timers T-C, -D, -E, -F as well as the timer T-G for automatically clearing the foregoing set conditions. Although it has been described with reference to FIG. 3 that the original support glass plate 11, when not in its start position for scanning, first moves in the direction of arrow a to the start position upon depression of the print key and thereafter moves in the direction of arrow b for the scan of the original, the first or preliminary movement of the glass plate 11 will not be mentioned in the description of the flow charts of FIG. 6 with reference to FIG. 7. Accordingly in the following description, the term "specified position" of the glass plate 11 means the scanning start position where the plate is stopped.

In step 60, the lapse of time set on the timer T-A is detected, whereupon the flag F-11 for setting scan starting conditions is set in step 61. Step 62 confirms the setting of the flag F-11, and step 63 subsequently checks whether or not the glass plate 11 is in its specified position. When the result is "YES", steps 64 to 69 are performed to energize the sensitizing and transfer chargers, to fully turn on the exposure lamp properly, to engage a clutch (not shown) for effecting a scanning movement, to set a timer T-B for setting the length of the scan and to reset the flag F-11.

Until the lapse of the time set on the timer T-B is detected in step 70 of FIG. 6 (*b*), an image is formed on the photoconductive drum 13, while with the start of the movement of the glass plate 11, suitable switching means is actuated to start feeding a sheet of copy paper.

When the lapse of the set time on the timer T-B is detected, steps 71 to 77 are executed to turn off the exposure lamp, to disengage the scan clutch, to de-energize the sensitizing charger, to set the flag F-12, to set the timer T-C for setting when to stop the developing motor, to set the timer T-D for determining when to start the next copying cycle for continuous copying, and to subtract a decrement from the value in the units position of the copy number setting counter described. If a borrow arises in the subtraction, the decrement "1" is borrowed from the tens position in step 79. If the value in the tens position is also "0" at this time, this is detected in steps 80 and 81. In step 82, the number of copies initially set is read out from the memory and set as the numerical value to be displayed for "restoration of set number". The flag F-1 is reset in step 83, indicating that there is no operation to be continued for image formation. When the results of steps 80 and 81 are "NO", step 84 follows with the flag F-1 in a set state to detect the lapse of time set on the timer T-C, whereupon the developing motor is de-energized in step 85.

In step 86, the termination of timing period of the timer T-E to be described later is detected, whereupon the transfer charger is turned off in step 87 and the timer T-F for auto-shut is set in step 88. Thus these steps 87 and 88 are executed on completion of the final copying cycle.

The timer T-D is checked for the lapse of time set thereon in step 89 of FIG. 6 (*c*). If the result is "YES", step 90 checks whether or not the flag F-1 is set, i.e. whether or not the subsequent copying operation is requested. When the flag F-1 is set, steps 91 to 94 are performed for initiating the subsequent copying operation by preliminarily turning on the exposure lamp, energizing the developing motor, setting the flag F-11 and resetting the flag F-12 for setting the condition for accepting a stop signal.

If the flag F-1 is found to be reset in step 90, the timer T-E for turning off the transfer charger is set in step 95. Step 96 follows to detect the lapse of time set on the above-mentioned auto-shut timer T-F, whereupon the main motor is turned off to stop the operation of the copying machine, and the timer T-G is set to clear the set conditions (steps 113 and 114) if no action is subsequently taken within a predetermined period of time.

Step 99 checks the flag F-2 for indicating conditions for discontinuing the copying operation being conducted. The flag F-2 is set, for example, in the event of absence of paper during a copying operation as shown in steps 104 to 106, or when the clear key 35 is depressed as shown in steps 107 to 110, or when the keys 31, 32 are depressed simultaneously as described for the third embodiment. If the flag F-2 is set, step 100 checks the flag F-12 as to whether or not a stop signal is acceptable. If the result is "YES", the flags F-12, F-2 and F-1 are reset to prevent the next copying operation. The condition in which the stop signal is acceptable as mentioned above refers to the state in which the flag F-1 is set during the period following the lapse of time set on the timer T-B until the time set on the timer T-D has elapsed.

In FIG. 6 (*d*), step 107 checks the clear key 35 for its depression. If it is derpessed, step 109 checks the flag F-1. When the flag F-1 is set, the flag F-2 is set, whereas if the flag F-1 is in a reset state, the flag F-3 is set. Steps 107 to 111 are omitted in the case of the third embodiment as already stated.

Since the setting of the flag F-2 is detected in step 99 and the flag F-1 is reset in step 103 the next copying operation is prevented. After the flag F-3 has been set, steps 112 and 114 follow to return the set number to the initial setting, namely "1".

Step 117 for detecting the lapse of time set on the internal timer in steps 2, 202, 302, 402 and 502 continues until the termination of the set period, whereupon the contents of the units counter and the contents of the tens counter are read out in steps 118 and 119 respectively, and the data is delivered from the output ports C0–C3 and D0–D3 of the microcomputer MC and displayed on the display 38. Step 120 processes the output for another load in the interior of the copying machine. Although the detection of the lapse of time set on the timer T-B is utilized in the above embodiment for subtracting a decrement from the set value for every copying cycle, also useful for this purpose are, for example, the paper feed start signal shown in FIG. 7, and the signal of a microswitch or the like, if such signal is used for returning the original support glass plate.

While the value "1" is displayed when the power supply is turned on according to the foregoing embodiments, the display may be adapted to show "1", for example, in response to a signal emitted when the heater of the fixing unit has been fully warmed up.

The preset counter apparatus of this invention is also usable for machines other than copying machines for presetting the number of repetitions of specified operation.

According to the embodiments described above, the completion of repeated copying cycles is detected by subtracting the decrement of "1" from the set copy number every copying cycle and resetting the flag F-1 when the values in all the digit positions have reduced to "0", indicating that no further copying operation is requested. This can be achieved alternatively with the use of a memory for storing the set copy number, a counter for counting up "1" every copying cycle and comparison means for comparing the count with the set value in the memory, such that a further copying cycle is prevented when the two values are found to match. However, the system used for the foregoing embodiments has the advantage that the copying operation can be discontinued only by detecting "0" without the need to separately provide the counter for counting the number of copying cycles, comparison means, etc.

It is to be further understood that various modifications of the generic concepts of this invention are possible without departing from its spirit and accordingly the scope of the present invention should be determined solely from the following claims.

What is claimed is:

1. A preset counter apparatus for copying machines and the like comprising:

display means for displaying a set numerical value;

key input means for increasing or decreasing the set numerical value;

timer means started initially by an ON input of the key input means for measuring predetermined periods of time and producing signals;

first control means, being activated by a signal from the timer means after every lapse of a period of time set on the timer means, for changing the set numerical value by 1 while a continuous ON input is being given by the key input means; and second control means, being activated by the signal from the tImer means after every lapse of a period of time, for shortening the period of time of the timer means and for starting the timer means with a shortened period of time, said second control means managing the shortening of the period of time at least several times with progressively lesser periods of time from an initial period of time until the period of time becomes a predetermined minimum period of time.

2. A preset counter apparatus as claimed in claim 1, wherein thekey input means includes an UP key and a DOWN key for respectively increasing and decreasing the set numerical value.

3. A preset counter apparatus for claimed in claim 1, wherein the first control means further changes the set numerical value by 1 every time the key input means is momentarily actuated.

4. A preset counter apparatus for copying machines and the like comprising:

means for displaying a set numerical value;

first, second and third key input means;

first timer means started initially by an ON input of one of the first or second key input means and producing a first timer signal;

second timer means start initially by an ON input of the third key input means and having a shorter period of time than the first timer means and producing a second timer signal;

control means being activated by a signal from either the first or second timer means while a continuous ON input is being given by the first, second or third key input means, for changing the set numerical value by an increment of 1 to a preceding set numerical value or by a decrement of 1 from the preceding set numerical value upon lapse of every period of time set on the first timer means, for changing the set numerical value by an increment of 1 to the preceding set numerical value upon lapse of every period of time set on the second timer means, and for starting again the lapsed first or second timer means in succession.

5. A preset counter apparatus as claimed in claim 4, wherein the control means further increases or decreases by 1 the set numrical value every time the first or second key input means is momentarily actuated.

6. A preset counter apparatus for copying machines asnd the like comprising:

display means for displaying a set numerical value;

first key input means for increasing the set numerical value;

second key input means for decreasing the set numerical value, and control means for causing the display means to display the minimum numerical value "1" when the first key input means is depressed after the maximum numerical value that can be displayed is displayed on the display means and to display the maximum numerical value when the second key input means is depressed after the minimum numerical vaslue "1" is displayed on the display means.

7. A preset counter apparatus for copying machines and the like comprising:

display means for displaying a set numerical value;

first key input means for increasing the set numerical value;

second key input means for decreasing the set numerical value, and control means for causing the machine to operate repeatedly a predetermined number of times in accordance with a set numericcal value larger than "1" and for discontinuing a repeated machine operation without changing the set numerical value displayed on the display means when said first and second key input means are depressed concurrently while the copying machine is repeating its operation.

8. A preset counter apparatus as claimed in claim 7, wherein said control means changes the set numerical value from a value displayed on the display means tO the minimum value "1" when said first and second key input means are depressed concurrently again after said first and second key input means are depressed concurrently.

9. A control system for a copying machine capable of duplicating orignals and indicating a numerical value representative of the number of duplicated copies to be reproduced, comprising:

display means for displaying the numerical value;

key input means including an UP key and a DOWN key for changing then numerical value by 1, and control means for progressively increasing the rate of change of a value of 1 in response to continuous activation of the key input means to provide an operator with an accelerated variation of displaying for relatively large numbers of duplicated copies.

10. The invention of claim 9 wherein activation of both the UP key and DOWN key simultaneously in a condition where the copying machine is repeating its operation will cause the control means to discontinue a repeated copy machine operation.

11. The invention of claim 9 wherein activation of both the UP key and DOWN key simultaneously, in a condition where the copy machine discontinues the operation, will cause a control means to clear the display means.

12. The invention of claim 9 wherein the control means will cause the maximum value to be followed on the display means with the minimum value "1" if an additional increment of value is added by the UP key.

13. The invention of claim 9 wherein the control means will cause the minimum value to be followed on the display means with the maximum value "1" if an additional decrement of value is subtracted by the DOWN key.

14. The invention of claim 9 wherein the control means increases the rate of change of value for each increment of value across a predetermined number of increments of values, at the end of the predetermined number of increments the rate of change of value will remain constant.

15. In a copying machine, the improvement comprising the preset counter apparatus having:

display means for displaying a set numerical value;

first key input means for increasing the set numerical value;

second key input means for decreasing the set numerical value;

first control means for causing the display means to display the minimum numerical value "1" when the first key input means is depressed after the maximum numerical value that can be displayed is displayed on the display means and to display the maximum numerical value when the second key input means is depressed after the minimum numerical value "1" is displayed on the display means, and second control means for causing the display means to display a numerical value which is one less than the previous displayed numerical value for every copy cycle and for causing the display means to display a numerical value that was previously set at the start of the copy cycle chromologically after a displayed value "1" which is a final result of a copying operation with a decrement after every copy cycle.

16. A preset counter apparatus for copying machines and the like comprising:

means for displaying a set numerical value;

first, second and third key input means;

first timer means started initially by an ON input of one of the first or second key input means and producing a first timer signal;

second timer means started initially by an ON input of the third key input means and having a shorter period of time than the first timer means and producing a second timer signal;

first control means being activated by a signal from either the first or second timer means while a continuous ON input is being given by the first, second or third key input means, for changing the set numerical value by an increment of 1 to a preceding set numerical value or by a decrement of 1 from the preceding set numerical value upon lapse of every period of time set on the first timer means, for changing the set numerical value by an increment of 1 to the preceding set numerical value upon lapse of every period of time set on the second timer means, and for starting again the lapsed first or second timer means in succession, and second control means causing the display means tro display the minimum numerical value "1" when the first or third key input means is depressed after the maximum numerical value that can be displayed is displayed on the display means and to display the maximum numerical value when the second key input means is depressed after the minimum numerical value "1" is displayed on the display means.

17. A control system for a copying machine capable of duplicating originals and indicating a numerical value representative of the number of duplicated copies to be reproduced, comprising:

display means for displaying the numerical value;

key input means including an UP key and a DOWN key for changing the numerical value by 1;

timer means started initially by an ON input of the key input means for measuring predetermined periods of time and producing signals;

first control means, being activated by a signal from the timer means after every lapse of a period of time set on the timer means, for changing the set numerical value by 1 while a continuous ON input is being given by the key input means, and for shortening theperiod of time of the timer means for starting the timer means with a shortened period of time, said shortening of the period of time starting with an initial time period and ending with a predetermined minimum final period of time with a plurality of time periods of progressively lesser time provided between the initial and final time periods for effectuating a change in the set numerial value;

second control means for causing the display means to display the minimum numerical value "1", when the UP key is depressed after a maximum numerical value that can be displayed is displayed on the display means, and to display the maximum numerical value, when the DOWN key is depressed after the minimum numerical value "1" is displayed on the display means, without ever displaying the value "0", and third control means for causing the machine to operate repeatedly a predetermined number of times in accordance with a set numerical value larger than "1" and for discontinuing a repeated machine operation without changing the set numerical value displayed on the display means when the UP and DOWN keys are depressed concurrently while the copying machine is repeating its operation.

18. A control system as claimed in claim 17, wherein said third control means changes the set numerical value from a value displayed on the display means to the minimum value "1" when the UP and DOWN keys are depressed concurrently again after the UP and DOWN keys are initially depressed concurrently.

* * * * *

UNITED STATES PATENT AND TRADEMARK OFFICE

CERTIFICATE OF CORRECTION

PATENT NO. : 4,646,330

DATED : February 24, 1987

INVENTOR(S) : MASAMICHI SUGIURA et al.

It is certified that error appears in the above-identified patent and that said Letters Patent is hereby corrected as shown below:

Col. 4, line 15: after "invention", delete ",", insert --;--.

Col. 5, line 5: delete "a", insert --a--;

line 9: delete "b", insert --b--.

Col. 13, line 53: before "flag F-3", insert --the--.

Col. 14, line 64: delete "a", insert --a--;

line 66: delete "b", insert --b--.

Col. 17, line 19: delete "tImer", insert --timer--;

line 29: delete "thekey", insert --the key--;

line 65: delete "asnd", insert --and--.

Col. 18, line 10: delete "vaslue", insert --value--;

line 29: delete "tO", insert --to--;

line 35: delete "orignals", insert --originals--.

UNITED STATES PATENT AND TRADEMARK OFFICE

CERTIFICATE OF CORRECTION

PATENT NO. : 4,646,330

DATED : February 24, 1987

INVENTOR(S) : MASAMICHI SUGIURA et al.

It is certified that error appears in the above-identified patent and that said Letters Patent is hereby corrected as shown below:

Col. 19, line 25: delete "chromologically", insert --chronologically--;

line 53: delete "tro", insert --to--.

Col. 20, line 22: delete "theperiod", insert --the period--.

Signed and Sealed this

Eighth Day of December, 1987

*Attest:*

DONALD J. QUIGG

*Attesting Officer*

*Commissioner of Patents and Trademarks*